US011076728B2

(12) United States Patent
Wallenius et al.

(10) Patent No.: US 11,076,728 B2
(45) Date of Patent: Aug. 3, 2021

(54) INSERT DISPENSER FOR A STACK OF SHEET PRODUCTS

(71) Applicant: SCA HYGIENE PRODUCTS AB, Gothenburg (SE)

(72) Inventors: Hans Wallenius, Gothenburg (SE); Björn Larsson, Gothenburg (SE)

(73) Assignee: Essity Hygiene and Health Aktiebolag, Gothenburg (SE)

( * ) Notice: Subject to any disclaimer, the term of this patent is extended or adjusted under 35 U.S.C. 154(b) by 398 days.

(21) Appl. No.: 15/776,283

(22) PCT Filed: Nov. 16, 2015

(86) PCT No.: PCT/SE2015/051219

§ 371 (c)(1),
(2) Date: May 15, 2018

(87) PCT Pub. No.: WO2017/086842

PCT Pub. Date: May 26, 2017

(65) Prior Publication Data

US 2020/0268221 A1 Aug. 27, 2020

(51) Int. Cl.
*A47K 10/42* (2006.01)
*A47F 3/02* (2006.01)
(Continued)

(52) U.S. Cl.
CPC ..... *A47K 10/424* (2013.01); *A47F 3/02* (2013.01); *A47F 7/0014* (2013.01); *A47F 7/0042* (2013.01); *A47K 2010/3233* (2013.01)

(58) Field of Classification Search
CPC ..... A47K 10/42; A47K 10/424; A47K 2010/3233; A47F 3/02; A47F 7/0014; A47F 7/0042
(Continued)

(56) References Cited

U.S. PATENT DOCUMENTS 861,245 A * 7/1907 Armstrong ..... B65H 3/24 271/135
1,398,283 A * 11/1921 Stice ..... G07F 11/04 194/260
(Continued)

FOREIGN PATENT DOCUMENTS

DE 1289274 B * 2/1969 ..... A47K 10/424
EP 2 283 757 A2 2/2011
(Continued)

OTHER PUBLICATIONS

International Search Report (PCT/ISA/210) dated Jul. 22, 2016, by the Swedish Patent Office as the International Searching Authority for International Application No. PCT/SE2015/051219.
(Continued)

*Primary Examiner* — Rakesh Kumar
(74) *Attorney, Agent, or Firm* — Buchanan Ingersoll & Rooney PC

(57) ABSTRACT

An insert dispenser includes a frame partly defining an interior volume for supporting a stack of sheets products, the frame having a frame panel portion extending in a transverse direction and provided with first and second opposite transverse edge surfaces, the dispenser further comprises a dispensing opening. Moreover, the dispenser further includes an abutment panel extending in the transverse direction and having an abutment surface for abutting a cabinet front door surface and a frame facing surface connected to the first transverse edge surface of the frame panel portion. The cabinet includes a cabinet front door, a housing defining an inner depth in a transverse direction, a dispensing outlet for sheet products and an insert dispenser includes a dispensing opening.

19 Claims, 8 Drawing Sheets

(51) Int. Cl.
*A47F 7/00* (2006.01)
*A47K 10/32* (2006.01)

(58) Field of Classification Search
USPC .... 221/45, 44, 54, 34, 102, 48, 62, 52, 155, 221/56, 63, 197
See application file for complete search history.

(56) References Cited

U.S. PATENT DOCUMENTS 1,546,807 A * 7/1925 Straubel ..... A47K 10/424 221/48
1,681,840 A * 8/1928 Carlson ..... A47K 10/424 221/34
1,709,214 A * 4/1929 Griffith ..... A47K 10/424 221/53
1,783,149 A * 11/1930 Jantzen ..... A47K 10/24 221/34
2,343,814 A 3/1944 Slye et al.
2,426,787 A * 9/1947 O'Neil ..... A47K 10/424 221/45
3,028,047 A * 4/1962 Tuft ..... A47K 10/424 221/44
3,269,592 A * 8/1966 Slye ..... A47K 10/424 221/44
3,597,032 A * 8/1971 Harangozo ..... A47K 10/42 312/34.4
3,887,106 A * 6/1975 Charlson ..... B65D 83/12 221/197
4,113,157 A * 9/1978 Woodbury ..... A44B 11/005 206/37
4,728,096 A * 3/1988 Winkler ..... G07D 11/10 271/166
5,074,430 A * 12/1991 Roberts ..... A47K 10/424 221/44
5,154,496 A * 10/1992 Campbell ..... A47K 10/32 221/199
5,335,822 A * 8/1994 Kasper ..... B65H 3/24 221/198
5,950,863 A * 9/1999 Schutz ..... A47K 10/424 221/46
6,003,723 A 12/1999 Morand
6,422,416 B1 * 7/2002 Tramontina ..... A47K 10/424 221/45
6,607,093 B1 * 8/2003 Morad ..... A47K 10/424 221/33
7,048,143 B2 * 5/2006 Sanders ..... A47K 10/422 221/46
7,128,238 B2 * 10/2006 Runnels ..... G07F 11/045 221/198
7,845,515 B2 * 12/2010 Moody ..... A47K 10/424 221/36
8,152,021 B2 * 4/2012 Babikian ..... A47K 10/425 221/45
8,608,023 B2 * 12/2013 Case ..... A47K 10/424 221/63
8,978,925 B2 * 3/2015 Babikian ..... A47K 10/42 221/45
10,398,265 B2 * 9/2019 Larsson ..... A47K 10/424
2011/0036855 A1 * 2/2011 Petocchi ..... A47K 10/3612 221/1
2011/0114661 A1 * 5/2011 Babikian ..... A47K 10/42 221/45
2020/0268221 A1 * 8/2020 Wallenius ..... A47F 7/0042

FOREIGN PATENT DOCUMENTS

EP 2283757 A3 * 3/2014 ..... A47K 10/3612
JP 4847626 B1 * 12/2011
RU 2018121833 A3 * 12/2019 ..... A47F 7/0014
WO WO 2014/200394 A1 12/2014
WO WO-2014200394 A1 * 12/2014 ..... A47K 10/424
WO WO-2016137364 A1 * 9/2016 ..... A47K 10/424

OTHER PUBLICATIONS

Written Opinion (PCT/ISA/237) dated Jul. 22, 2016, by the Swedish Patent Office as the International Searching Authority for International Application No. PCT/SE2015/051219.
Written Opinion of the International Preliminary Examining Authority (PCT Rule 44bis) (PCT/IPEA/408) dated Oct. 12, 2017, by European Patent Office as the International Application No. PCT/SE2015/051219.
Notification of Transmittal of the International Preliminary Report on Patentability (Form PCT/IPEA/416) and International Preliminary Report on Patentability (Form PCT/IPEA/409) dated Dec. 6, 2017, by the European Patent Office for International Application No. PCT/SE2015/051219.
Office Action issued in corresponding Russian Patent Application No. 2018121833(034545), dated Feb. 5, 2019, and translation (13 pages).
Extended European Search Report issued in corresponding European Patent Application No. 15908893.9, dated Jul. 1, 2019 (4 pages).

* cited by examiner

INSERT DISPENSER FOR A STACK OF SHEET PRODUCTS

TECHNICAL FIELD

The present disclosure relates to an insert dispenser intended for installation in a cabinet, and which is configured to contain and dispense a stack of sheet products. The disclosure also relates to a cabinet comprising an insert dispenser as well as the use of an insert dispenser in a cabinet.

BACKGROUND

In the field of dispensers and dispenser systems, there are a number of solutions relating to sheet product dispensers in which sheet products are dispensed from a frame or housing through a dispensing opening. Examples of types of sheet products that are known are hand towels, toilet tissue, napkins, and other wiping products in sheet form.

Sheets of web material to be dispensed from a dispenser come in various sizes. In particular paper towels may be provided having different widths. The sheet products are typically folded and stacked.

A basic dispenser comprises a frame or housing provided with a dispensing opening at a lower end of the housing. Some dispensers comprise a storage compartment for stacked sheet products formed integrally with the housing. Other dispensers for stacked sheet products may be provided separate from the housing, and are intended to be arranged inside a cabinet. Accordingly, some dispensers are designed to be used as stand-alone, whilst other type of dispensers may be configured to be housed in existing cabinet installations. Typically, the dimensions of existing cabinets in public restrooms are standard and also often adapted to meet other standards such as requirements for disabled toilets or the like.

As an example, an insert dispenser can be mounted within a cabinet to enable the cabinet to be used for towels of a different size than the towels intended to be used with the specific cabinet.

WO 2014/200394 discloses one type of dispenser adapted to be arranged in a cabinet. The dispenser comprises a support arrangement for supporting a stack of sheets of web material arranged at a dispensing end of the dispenser. Further, the dispenser has first and second side walls and a third side wall extending between the first and second side walls. In one embodiment, a first bracket extends from an edge of the first side wall and a second bracket extends from an edge of the second side wall.

SUMMARY OF THE DISCLOSURE

An object of the disclosure is to provide an improved insert dispenser intended to be arranged in a cabinet, and to improve the general interaction between the insert dispenser and the cabinet.

The disclosure concerns an insert dispenser intended for installation in a cabinet. The dispenser comprises a frame partly defining an interior volume for supporting a stack of sheets products. The frame has a frame panel portion extending in a transverse direction Y and provided with first and second opposite transverse edge surfaces. Further, the dispenser comprises a dispensing opening. Moreover, the dispenser comprises an abutment panel extending in the transverse direction Y and having an abutment surface for abutting a cabinet front door inner surface and a frame facing surface connected to the first transverse edge surface of the frame panel portion.

By the arrangement of the abutment panel on the insert dispenser, the dispenser is provided with an abutment surface for delimiting further movement of a cabinet front door of a cabinet towards the frame of the dispenser containing the stack of sheet products. That is, the arrangement of an abutment panel extending in the transverse direction and being connected to a transverse edge surface of an insert dispenser prevents that the cabinet front door is pushed further in the transverse direction Y towards the frame of the insert dispenser and the stack of sheet products. Accordingly, the insert dispenser is configured by the abutment panel to safeguard that there is sufficient space for the stack of the sheet products in the frame of the dispenser when the insert dispenser is installed and used in a conventional existing cabinet. To this end, the insert dispenser according to the above configuration contributes to improve the interaction between the insert dispenser and the cabinet and the overall functionality of the system so that sheet products can be easily dispensed from the system in use.

By way of an example, when the insert dispenser is arranged in a cabinet and when the cabinet front door of the cabinet is in a closed configuration with the housing of the cabinet, the abutment surface of the abutment panel is capable of abutting the inner surface of the cabinet front door. In this manner, there is provided an insert dispenser having an abutment panel configured to abut the cabinet front door in order to avoid, or at least minimize the risk, that the cabinet door negatively influences the dispense of the sheet products when the cabinet is to be used, i.e. when the cabinet door is closed.

By the provision that the abutment panel extends in the transverse direction Y and is connected to the first transverse edge surface of the frame panel portion, it becomes possible to increase the length of the dispenser in the transverse direction Y in a simple, yet effective manner, and without compromising the overall function of the insert dispenser.

An object of the present disclosure is also at least partly achieved by the features of a cabinet comprising a cabinet front door, a housing, a dispensing outlet for sheet products, wherein an insert dispenser according to any one of the features, examples or variants mentioned above, and further herein with the respect to the insert dispenser, is arranged inside the cabinet with the dispensing opening arranged in connection with the dispensing outlet of the cabinet and with the abutment surface of the abutment panel oriented towards the cabinet front door, whereby the abutment surface abuts the cabinet front door when the cabinet front door is in a closed configuration with the housing of the cabinet.

Thus, when the insert dispenser is arranged in the cabinet, the abutment surface of the abutment panel abuts the cabinet front door when the cabinet front door is in the closed configuration with the housing of the cabinet.

An object of the present disclosure is also at least partly achieved by the features of a cabinet comprising a cabinet front door, a housing defining an inner depth E in a transverse direction Y, a dispensing outlet for sheet products and an insert dispenser comprises a dispensing opening. The dispenser has an extension D in the transverse direction Y and comprises a frame partly defining an interior volume for supporting a stack of sheets products. The frame has a frame panel portion extending in the transverse direction Y. Further, the frame has an abutment panel extending from the frame panel portion in the longitudinal direction X. The abutment panel has an abutment surface for abutting a cabinet front door inner surface.

The dispenser is arranged inside the cabinet with the dispensing opening arranged in alignment with the dispensing outlet of the cabinet and with the abutment surface oriented towards the cabinet front door. In addition, the extension D of the dispenser in the transverse direction Y is larger than the inner depth E of the cabinet, as seen in the transverse direction Y.

Hereby, the abutment surface urges the cabinet front door when the cabinet front door is in a closed configuration with the housing of the cabinet.

Thus, when the insert dispenser is arranged in the cabinet, the abutment surface of the abutment panel urges the cabinet front door when the cabinet front door is in the closed configuration with the housing of the cabinet. Typically, the abutment panel urges an inner part of the cabinet front door when the cabinet front door is in the closed configuration with the housing of the cabinet.

By using an insert dispenser with a larger extension in the transverse direction than the inner depth of the cabinet, it is believed that the cabinet front door will somewhat deform when set in the closed configuration with the housing of the cabinet. In this manner, the inner volume of the frame containing the stack of sheet products can maintain its size in order to ensure a safe and reliable dispense of the stack of sheet products.

Further, it becomes possible to increase the length of the dispenser in the transverse direction in a simple, yet effective manner, and without compromising the overall function of insert dispenser and the cabinet. The transverse length of the abutment panel and the transverse length of the frame of the dispenser are typically selected in view of the inner depth E of the cabinet in order to ensure that the overall extension D of the dispenser is larger than the inner depth of the cabinet.

Another exemplary advantage of the abutment panel of the dispenser is to provide support for the stack of sheet products, such that the stack will not fall out from the frame of the dispenser, e.g. when the cabinet front door is opened by a user.

The disclosure also relates to the use of an insert dispenser, according to any one of the features, examples or variants mentioned above, in a cabinet.

The insert dispenser is typically a removable unit. However, the insert dispenser may also be arranged to form an integral part of the cabinet.

Further optional features of the exemplary embodiments of the disclosure are recited in the dependent claims.

Typically, when the dispenser is arranged in a cabinet, the first transverse edge surface is the edge of the frame panel portion being arranged to face the cabinet door in the closed configuration of the cabinet. Accordingly, when the dispenser is arranged in the cabinet, the second transverse edge surface is the edge of the frame panel portion which is arranged to face a rear wall of the cabinet.

Each one of the frame panel portions may also be provided with opposite longitudinal edge surfaces and opposite vertical edge surfaces.

Typically, the frame and the abutment panel are separate parts of the dispenser. By designing the frame and the abutment panel as individual parts, it is believed that the mass-production of the dispenser may be simplified in a cost-efficient manner.

Thus, the frame panel portion and the abutment panel are separate parts of the dispenser.

In one exemplary embodiment, the abutment panel is permanently connected to the first transverse edge surface of the frame panel portion. As an example, the abutment panel can be glued or welded to the first transverse edge surface of the frame panel portion.

In one exemplary embodiment, the abutment panel is detachable connected to the first transverse edge surface of the frame panel portion. In this manner, the abutment panel is allowed to be replaced, adjusted or removed. As such, a user can decide to remove the abutment panel or adjust the position of the member when it is necessary to refill the dispenser with a new stack of sheet products in an easy and convenient manner. Accordingly, a detachable connected abutment panel provides for a more flexible insert dispenser in terms of use and installation. As an example, the abutment panel comprises a snap fit mechanism configured to detachably connect the abutment panel to the first transverse edge surface of the frame panel portion.

In addition, or alternatively, the position of the detachable connected abutment panel may be adjustable along the first transverse edge surface of the frame panel portion.

In addition, or alternatively, the adjustable abutment panel may be slidable arranged along a guiding recess extending in a vertical direction Z along said first transverse edge surface of the frame panel portion.

Typically, although not strictly necessary, the frame panel portion may comprise a plurality of connecting regions configured for connecting the abutment panel onto the first transverse edge surface.

When the frame panel portion comprises the plurality of connecting regions, each one being configured for connecting an adjustable abutment panel onto said first transverse edge surface, there is provided an insert dispenser in which an adjustable abutment panel is permitted to be connected and positioned at several different locations.

The abutment panel can be provided in many different shapes. One example shape of the abutment panel is a bracket-shaped member. The bracket-shaped abutment panel may have a second frame facing surface arranged perpendicular to a first frame facing surface. In other words, this type of abutment panel forms essentially an L-shaped abutment panel, in which the first frame facing surface is arranged perpendicular to the second frame facing surface. However, the abutment panel is not limited to this type of shape, but may likewise be provided as essentially flat panel. In other design variants, the abutment panel may resemble an essentially flat triangular shaped panel or an essentially flat rectangular shaped panel as long as the abutment panel is capable of providing the example effect and function as described above.

In order to provide a sufficient level of stability and integrity to the insert dispenser when the dispenser is arranged in the cabinet and the abutment panel abuts the cabinet front door, the abutment panel generally extends a substantial part in a vertical direction Z and substantial part in a longitudinal direction X towards a centre line C of the dispenser.

In addition, or alternatively, the abutment panel may essentially resemble a right angled triangle, as seen in the vertical direction Z and in the longitudinal direction X, whereby a side region surface of the abutment panel adjacent the right angle is connected to the first transverse edge surface of the frame panel portion.

In one design variant, a side of the abutment panel opposite the right angle defines an angle of entry for the sheet products to be dispensed in the vertical direction. The angle of entry is typically less than or equal to 35 degrees, still preferably the angle of entry is less than or equal to 30 degrees, still preferably the angle of entry is less than or equal to 25 degrees. In this manner, the shape of the abutment panel further contributes to improve the dispense of the sheet products from the dispenser. In particular, it decreases the risk of having sheet products stuck or jammed inside the frame of the dispenser. In other words, the above configuration of the abutment panel enables that the stack of sheet products can move freely downwards to the dispensing opening of the insert dispenser.

Typically, although not strictly required, the dispenser may comprise a plurality of abutment panels connected spaced apart to the first transverse edge surface of the frame panel portion, as seen in the vertical direction Z.

Typically, the abutment panel is arranged such that stacks of sheet products can be loaded into the storage compartment from a transverse side of the dispenser, typically corresponding to the accessible side of the cabinet when the cabinet front door is open.

In one exemplary embodiment, the frame panel portion is a first side panel portion essentially extending along the vertical direction Z.

In one exemplary embodiment, the frame further comprising a second side panel portion essentially extending in the vertical direction and a third panel portion extending between said first side panel portion and said second side panel portion, as seen in the longitudinal direction X.

In one exemplary embodiment, the first side panel portion, the second side panel portion and the third panel portion are arranged to form a storage compartment for receiving and holding the stack of sheet products. In this manner, the first side panel portion, the second side panel portion and the third panel portion define the interior volume of the dispenser.

In addition, or alternatively, the frame panel portion may be a longitudinal extending panel portion essentially extending in a longitudinal direction X. As an example, the longitudinal extending panel portion may correspond to the third panel portion.

According to one exemplary embodiment, the dispenser further comprises at least one vertical extension member essentially extending in the longitudinal direction X and the vertical direction Z and having a thickness in the transverse direction Y. Further, the vertical extension member is configured to detachable connect to the second transverse edge of the frame panel portion. A vertical extension member extends the transverse extension of the insert dispenser in a simple, yet stable manner. The extension member is particularly useful when the insert dispenser is installed in a cabinet of larger inner dimensions in the transverse direction.

In one exemplary embodiment, the insert dispenser is a hygienic sheet material insert dispenser for supporting a stack of sheet products such as hand towels, toilet tissue, napkins, or other wiping products in sheet form.

As mentioned above, the insert dispenser according to the exemplary embodiments is typically realised as an insert in an empty housing of a cabinet. Typically, the insert dispenser is configured to be removably mounted.

Accordingly, when the cabinet front door is in the closed configuration with the housing of the cabinet, the abutment panel urges the cabinet front door in a direction away from said frame of the dispenser.

In one exemplary embodiment, an extension D of the dispenser in the transverse direction Y is larger than an inner depth E of the cabinet, as seen in the transverse direction Y.

Typically, the inner depth E of the cabinet corresponds to the maximum inner depth as defined in a non-deformable state of the cabinet when the cabinet is without the insert dispenser and the cabinet front door is in the closed configuration with the housing of the cabinet.

In addition, or alternatively, the inner depth E of the cabinet is defined by the transverse length of an inner surface of a cabinet side wall segment.

In one exemplary embodiment, the cabinet housing comprises a rear wall segment.

The extension D of the dispenser in the transverse direction Y may be defined as the distance between a surface of the dispenser intended for abutting the rear wall segment, when the dispenser is arranged in the cabinet, and the abutment surface of the abutment panel.

In one exemplary embodiment, the abutment panel abuts an outermost longitudinal region of the cabinet front door, as seen when the cabinet front door is in the closed configuration with the housing of the cabinet.

The housing of the cabinet may comprise a space for accommodating the insert dispenser.

The insert dispenser may likewise comprise a space for accommodating a stack of sheet products, a dispensing opening for the sheet material, a fastening arrangement for fastening the insert dispenser in the cabinet. However, the fastening arrangement may likewise be applied to the cabinet, or onto both the dispenser and the cabinet.

It is to be noted that the features and the exemplary embodiments described with respect to the cabinet are applicable to any one of the exemplary embodiment of the insert dispenser herein.

The term "sheet products" is to be understood as a material, e.g. a web material, comprising folded sheets arranged in a stack, typically tissue, paper towels or other hygienic towels. The sheets may be folded in a manner suitable for dispensing single sheets. For example the sheet products may be provided as two continuous perforated webs being interleaved to form a double web with the perforation lines of each web arranged in an offset relationship, or the web material may be provided as individual interleaved sheets or merely folded sheets. Other type of web materials and other type of folded sheets are also readily conceivable in the context of the exemplary embodiments herein.

By the provision that the dispenser has a dispensing opening, it becomes possible to provide an opening through which the sheet products can be dispensed.

In one exemplary embodiment, the dispenser comprises a stack support structure having the dispensing opening, and which extends between the first side panel portion and the second side panel portion. In this manner, a stack support structure having a high structural stability is provided.

Further, the stack support structure provides an efficient support for the sheet products contained in the dispenser.

Further, the stack support structure may comprise an inner supporting surface for supporting abutment against the stack of sheet products.

The dispensing opening and the stack support structure should be configured so that sheet products can easily be pulled out through the dispensing opening.

In the above, the terms "longitudinal", "transverse" and "vertical", "uppermost" and "lowermost", "front", "side" and "rear", "downwardly" and "upwardly" are to be understood as seen when the dispenser is arranged for use in a cabinet.

As mentioned above, the dispenser is to be used with an existing cabinet. In other words, the dispenser should be able to fit within such a cabinet. Typically, the dispenser should fit in a variety of existing cabinets. This may lead to restrictions regarding the external dimensions of the dispenser. Therefore, the dispensing of the sheet products should be designed to allow for dispensing in a variety of existing cabinet dispensing openings. Since the width dimension of the dispenser, as seen in the longitudinal direction, can be set and maintained in correspondence with the type of sheet product to be used, a range of different sheet products can be used together with the cabinet. The cabinet thereby does not have to be replaced if the type of sheet product which is to be used is changed. Typically, the insert dispenser should be designed to tolerate sheet products with different numbers of folds and to also tolerate stacks with differing stack compression levels, without necessarily requiring adjustment to the components of the dispenser.

As mentioned above, the cabinet may be provided with a door for permitting access to the dispenser. Thereby sheet products can be loaded into the dispenser without removing the dispenser from the cabinet.

Further features of, and advantages with, the exemplary embodiments will become apparent when studying the appended claims and the following description. The skilled person realize that different features of the exemplary embodiments may be combined to create variants and exemplary embodiments other than those described in the following, without departing from the scope of the present disclosure, as defined by the appended claims.

BRIEF DESCRIPTION OF THE DRAWINGS

With reference to the appended drawings, below follows a more detailed description of embodiments of the disclosure cited as examples.

DETAILED DESCRIPTION OF EXEMPLARY EMBODIMENTS

Figure 1A:
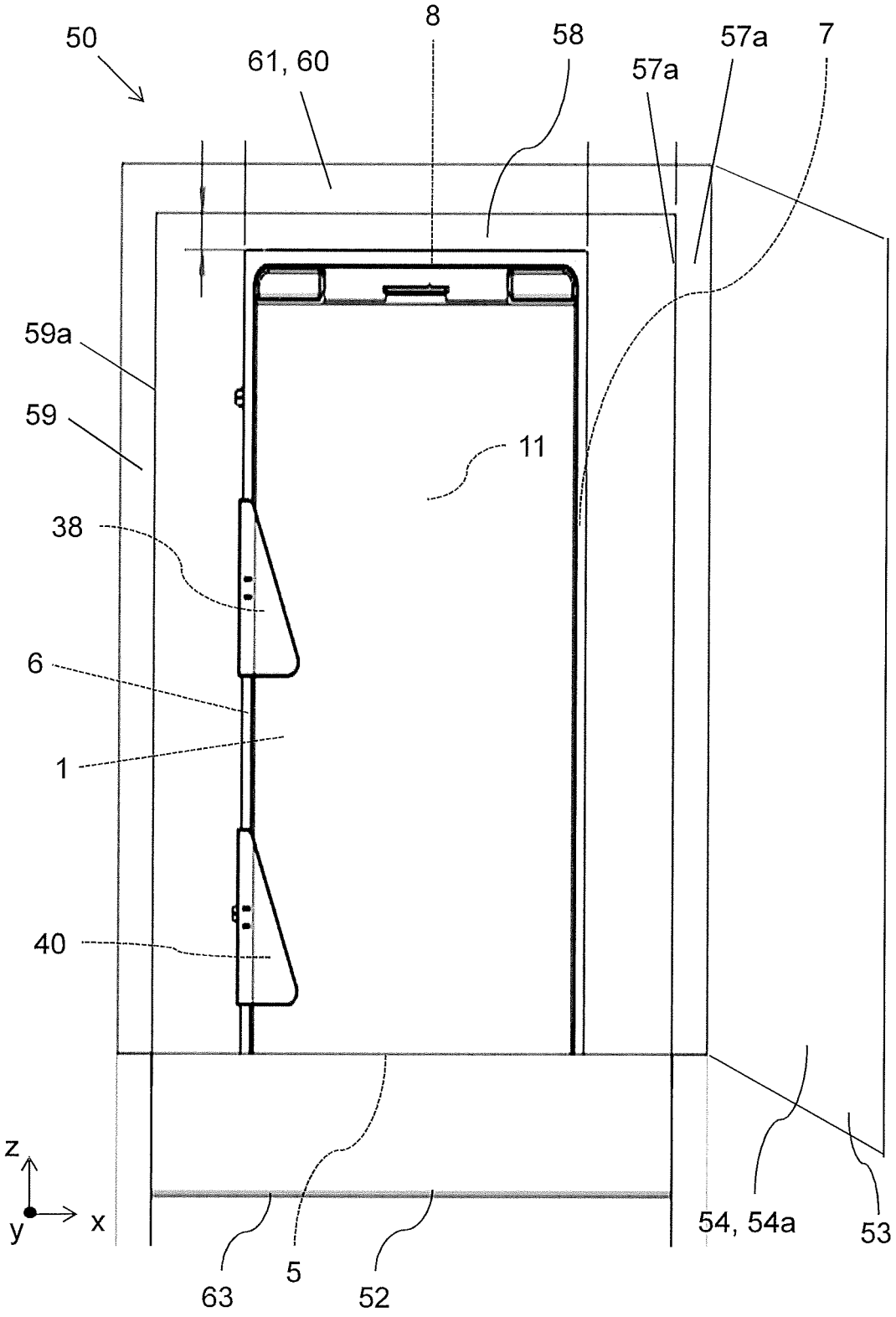
FIG. 1*a* is a perspective view of a dispenser arranged in a cabinet according to exemplary embodiments of the disclosure, in which the cabinet is illustrated with the cabinet door in an open configuration.

The present disclosure will now be described more fully hereinafter with reference to the accompanying drawings, in which exemplary embodiments of the disclosure are shown. The disclosure may, however, be embodied in many different forms and should not be construed as limited to the embodiment set forth herein; rather, these embodiments are provided for thoroughness and completeness. Like reference character refer to like elements throughout the description.

Figure 1B:
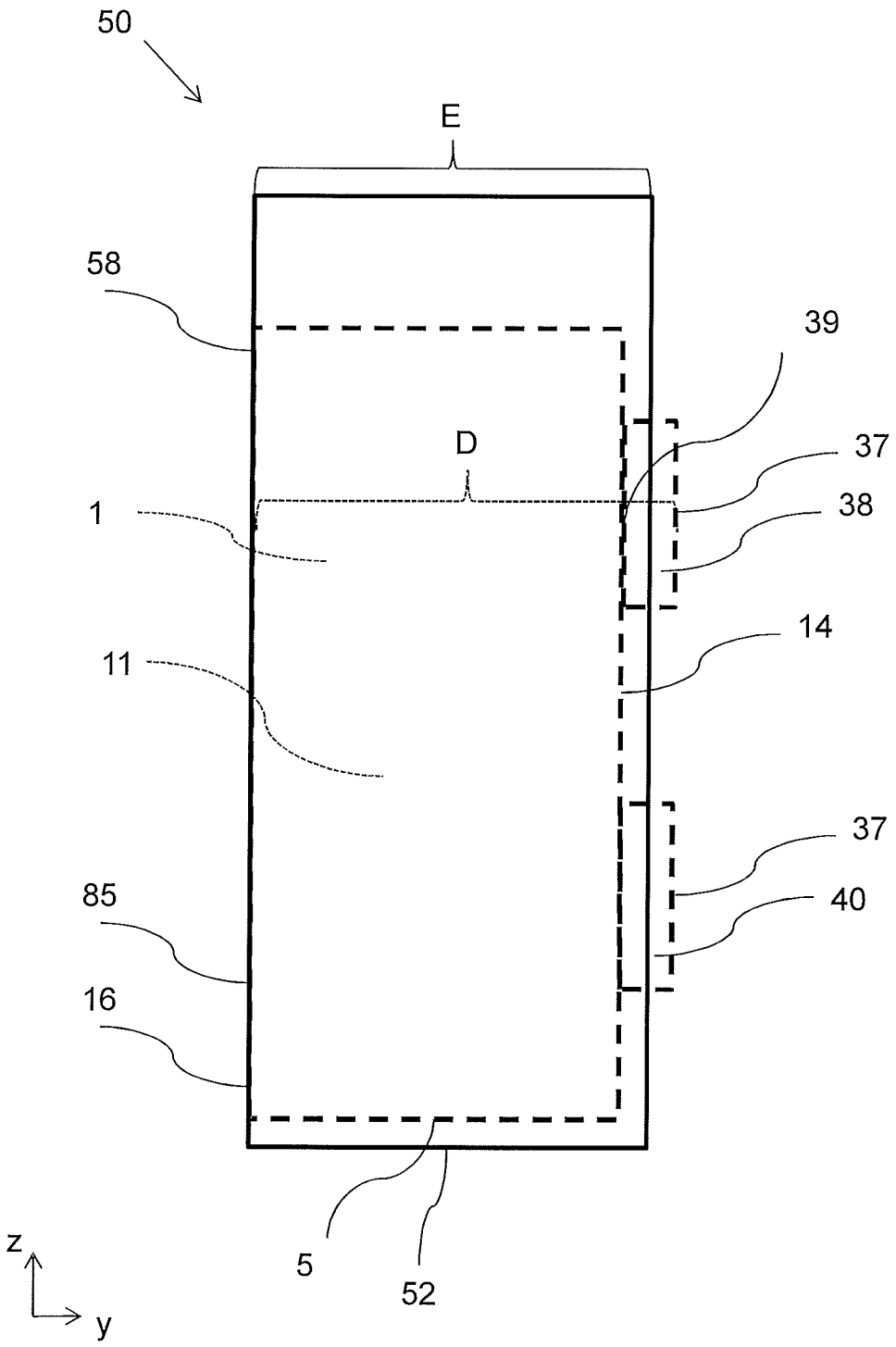
FIG. 1*b* shows a schematic illustration of a side view of the dispenser arranged in the cabinet according to exemplary embodiments of the disclosure, however, the cabinet is here illustrated without a cabinet front door.

In FIG. 1*a* of the drawings an exemplary embodiment of a dispenser 1 is schematically illustrated in an assembled state. The dispenser 1 is arranged in a cabinet 50 for storing a stack of sheet products and dispensing sheet products to a user. In order to clearly explain the design and operation of the dispenser 1, the contour of the dispenser 1 is indicated with lines in FIGS. 1*a*,1*c* and 1*d*. In FIG. 1*b*, the contour of the dispenser 1 is indicated with broken lines. In addition, some components are enlarged in relation to other components in order to facilitate the understanding of the exemplary embodiments.

Figure 1C:
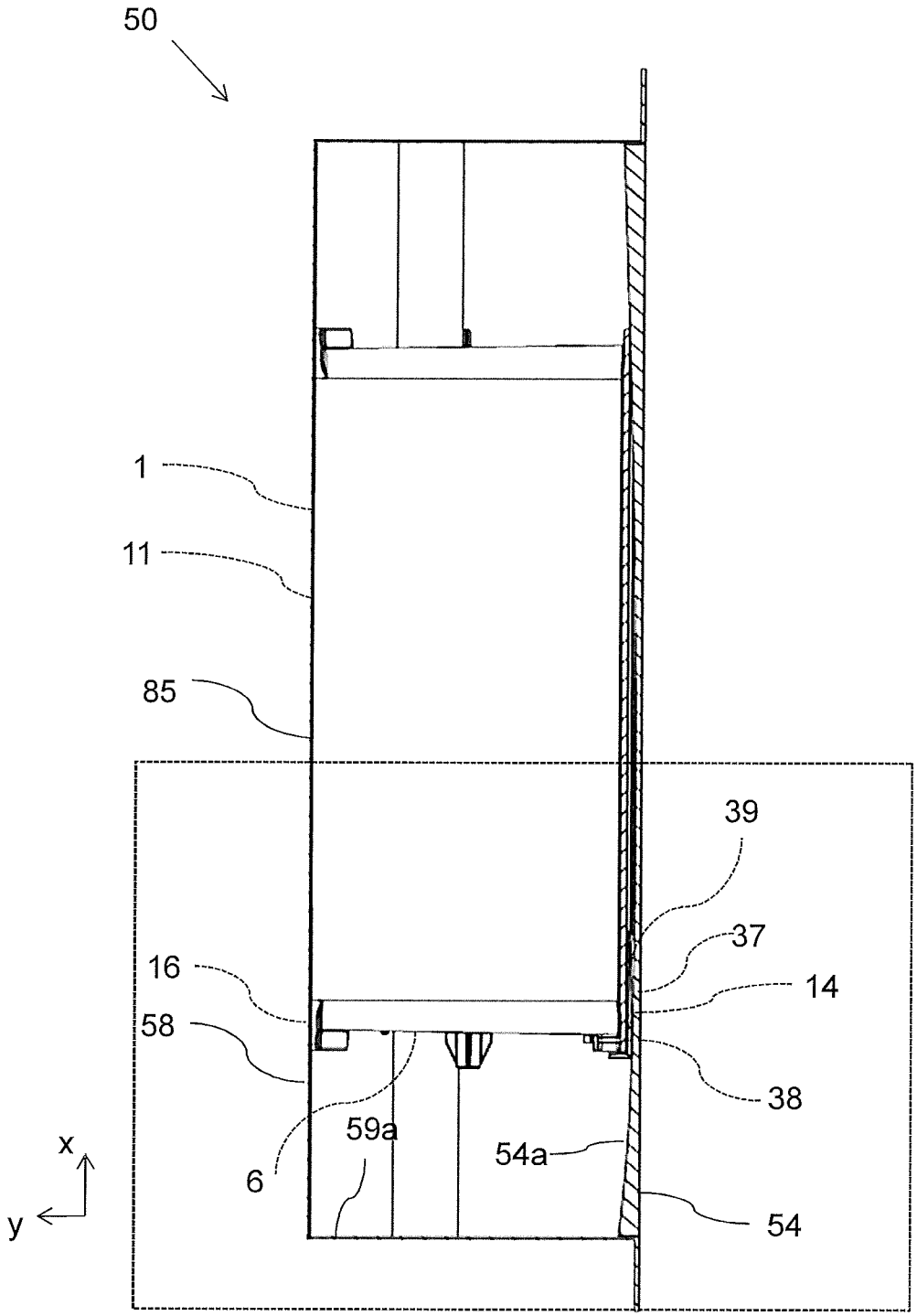
FIG. 1*c* shows a schematic illustration of a top view of the dispenser arranged in the cabinet according to exemplary embodiments of the disclosure, when the cabinet front door is in a closed configuration with the housing of the cabinet.

Typically, the dispenser 1 is an insert dispenser intended for installation in a cabinet, as shown in the FIGS. 1*a*-1*d*. Thus, the dispenser 1 is here adapted to be mounted in the cabinet 50. The dispenser, as illustrated in FIG. 1*a*-1*c*, is a hygienic sheet material dispenser for supporting a stack of sheet products such as hand towels, toilet tissue, napkins, or other wiping products in sheet form. The sheet products may be interleaved. More generally, the sheet products have a wiping function. Thus, FIG. 1*a* illustrates a dispenser 1 for storing a stack of sheets of web material such as paper towels and for dispensing sheets of the web material.

In this context of the exemplary embodiments, it is to be noted that the dispenser may be configured for storing and dispensing of differently sized sheets products. Thus, it should be readily appreciated that the dispenser can be used together with a wide range of different types of sheet products and web materials, especially with a wide range of differently sized sheets of web material.

By providing an insert dispenser intended for installation in a cabinet, other types of sheet products, especially other types of paper towels, than the ones for which the cabinet 50 is intended can be used together with the cabinet. The cabinet thus does not need to be replaced if there is a need or wish to change the type of sheet products used. In one exemplary embodiment, the sheet product is an interleaved sheet product such as an interleaved wiping tissue material.

However, although the following description has been made on an insert dispenser arranged in a cabinet, the dispenser may in some installations also be realised as an integral part of a cabinet 50. It may even be appreciated that the dispenser in some occasions can be provided as a stand-alone dispenser. In this exemplary embodiment, the dispenser typically includes some kind of outer cover to the dispenser so as to protect the stack stored in the storage compartment from becoming wet or soiled.

For ease of reference, the insert dispenser may sometimes only be denoted as the dispenser.

The insert dispenser shown in the FIGS. 1*a*-1*d* and 2*a*-2*d* is typically removably mounted in an empty housing 60 of the cabinet 50. The cabinet can be integrated into a wall of a public toilet, public restroom or the like. Generally, the insert dispenser is intended for use in an existing cabinet in a public toilet, public restroom or the like.

With particular reference to FIGS. 1*a*-1*d*, there is depicted an exemplary embodiment of the cabinet 50 comprises the dispenser 1. Furthermore, the cabinet 50 comprises a cabinet front door 54, a housing 60 defining an inner depth E in a transverse direction Y and a dispensing outlet 52 for sheet products. Typically, the dispenser 1 is arranged inside the cabinet with its dispensing opening in alignment with the dispensing outlet 52 such that sheets from a stack of sheet products arranged in the dispenser 1 can be dispensed from the cabinet 50.

The door 54 permits access to the dispenser 1. In addition, the door 54 is typically pivotally connected to the housing. By way of example, the door is pivotally connected to the housing by one or several hinges (although not shown).

As illustrated in the figures, the cabinet 50 has an extension in a longitudinal direction X, an extension in a transverse direction Y and an extension in a vertical direction Z. Analogously, the dispenser 1 has an extension in the longitudinal direction X, an extension in the transverse direction Y and an extension in the vertical direction Z.

The housing of the cabinet here includes a rear wall segment 58, as seen in the transverse direction Y, and opposite side wall segments 57 and 59 extending from the rear wall segment 58. As illustrated in FIGS. 1*a* and 1*b*, the door 54 is pivotally connected to the side wall segment 57. In this manner, it becomes possible to open and access an insert dispenser arranged in the housing. In other words, the door allows the dispenser to be loaded with one or several stacks of sheet products.

The cabinet front door is typically moveable between an open configuration and a closed configuration. The open configuration refers to a state when the door is open and the insert dispenser is accessible from the outside of the cabinet. The closed configuration refers to a state when the door is engaged to the housing of the cabinet. In the closed configuration, the cabinet front door is locked to the housing of the cabinet so as to form a ready-to-use state. The closed configuration thus typically corresponds to a ready-to-use state of the cabinet.

In some examples, the housing may also have a front wall segment including the door 54. Furthermore, the housing in this exemplary embodiment has a top segment 61 extending between the side wall segments 57 and 59, as seen in the longitudinal direction X. As shown in FIGS. 1*a* and 1*b*, the cabinet also has a bottom segment 63 including the dispensing outlet 52. In one design variant, the dispensing outlet is defined by the gap between the opposite side wall segments. However, the dispensing outlet is typically provided by a cut-out or recess in the bottom segment 63. The dispensing outlet can be an integral part of the housing or a separate part connected to the housing, while forming a part of the cabinet.

In the exemplary embodiment illustrated in FIGS. 1*a*-1*d*, and further described in conjunction with FIGS. 2*a*-2*d*, the dispenser 1 comprises a frame 10 partly defining an interior volume 11 for supporting a stack of sheets products. As mentioned above, the dispenser has an extension D in the transverse direction Y. The frame has a frame panel portion 6 extending in a transverse direction Y. The frame panel portion is provided with first and second opposite transverse edge surfaces 14, 16. In the example as shown in FIGS. 1*a*-1*d* and 2*a*-2*d*, the frame panel portion is the first frame side panel portion 6, hereinafter denoted as the first side panel portion 6. In addition, the frame here comprises a second side panel portion 7 and a longitudinal panel portion 8, as will be further described in relation to FIGS. 2*a*-2*d*.

The dispenser also comprises a dispensing opening 5. The dispensing opening is oriented such that the opening is in alignment with the dispensing outlet of the cabinet in order to ensure that sheet products can be dispensed from the dispenser through the dispensing outlet 52. The dispensing opening is adapted to allow a user to grasp at least one hanging sheet product.

Moreover, as illustrated in e.g. FIGS. 1*a*-1*d*, the dispenser comprises an abutment panel 38 extending in the transverse direction Y. The abutment panel has an abutment surface 37 for abutting a cabinet front door inner surface 54*a* and a frame facing surface 39 connected to the first transverse edge surface 14 of the frame panel portion. When the dispenser is arranged in the cabinet, the abutment surface of the abutment panel abuts the cabinet front door, i.e. the inner surface of the cabinet front door 54*a*. Further, in FIG. 1*b*, it is to be noted that the dimension of abutment panel 38 in the transverse direction Y is somewhat enlarged in order to illustrate the extension of the panel in the transverse direction Y. However, the figures are schematic illustrations of the exemplary embodiments, and the example in FIG. 1*b* is only enlarged in order to facilitate the understanding of exemplary embodiments. The dispenser and the abutment panel 38 are further described herein in conjunction with FIGS. 2*a*-2*d* and 3*a*-3*c*.

As mentioned above, the dispenser 1 comprises the frame 10 partly defining an interior volume 11 for supporting a stack of sheets products, in which the frame has a frame panel portion extending in a transverse direction Y. In one design variant, although not illustrated, the frame has an abutment panel extending from the frame panel portion in the longitudinal direction X. Further, as mentioned above, the abutment panel has an abutment surface for abutting a cabinet door surface. Thus, in this design variant, the abutment panel may be an integral part of the frame as long as the abutment panel extends from the frame panel portion in the longitudinal direction X.

The dispenser as illustrated in the figures may optional include an additional abutment panel 40.

As shown in FIGS. 1*a*-1*d*, the dispenser 1 is mounted in the cabinet 50. The dispenser 1 is arranged inside the cabinet 50 with the dispensing opening 5 in alignment with the dispensing outlet 52 of the cabinet. In other words, the dispenser is arranged inside the cabinet with the dispensing opening 5 arranged in connection with the dispensing outlet 52 of the cabinet.

Moreover, the dispenser is arranged inside the cabinet with the abutment surface 37 oriented towards the cabinet front door 54, whereby the abutment surface abuts the cabinet front door when the cabinet front door is in the closed configuration with the housing of the cabinet. That is, the dispenser is arranged inside the cabinet with the abutment surface 37 oriented towards the inner surface of the cabinet front door 54, whereby the abutment surface abuts the inner surface of the cabinet front door.

Accordingly, the abutment panel(s) 38 and 40 are arranged to face the door 54, when the door is in the closed configuration. To this end, the transverse edge surface 16 of the frame panel portion 6 is arranged to face the rear wall segment 58 of the cabinet.

When the cabinet front door is open, the interior volume defined by the dispenser frame can be accessible from the outside. Thereby, the dispenser 1 can be loaded with sheet products or web material without removal from the cabinet 50. If the door 54 is opened whilst the dispenser 1 is still at least partly loaded with sheet products, the abutment panels 38 and 40 typically also prevent the sheet products from falling out. Although the door 54 is illustrated as being hinged at the right hand side in FIGS. 1*a* and 1*b*, it can equally be mounted such as to be hinged at the left hand side.

The dispenser 1 should be arranged in the cabinet so as not to interfere with the functioning of the cabinet. Particularly, it should not interfere with the hinges of the door 54.

Moreover, the dispenser should be dimensioned in the longitudinal direction X and in the vertical direction Z so as to fit inside the cabinet.

However, as illustrated in the exemplary embodiments in the FIGS. 1*a*-1*d*, and partly also described in relation to 2*a*-2*d*, the extension D of the dispenser in the transverse direction Y is larger than the inner depth E of the cabinet, as seen in the transverse direction Y. In this manner, the dispenser is dimensioned to safeguard that there is sufficient space for the stack of the sheet products in the frame of the dispenser when the insert dispenser is installed and used in a conventional existing cabinet. To this end, the insert dispenser according to the above configuration contributes to improve the interaction between the insert dispenser and the cabinet and the overall functionality of system so that sheet products can be easily dispensed from the system in use.

According to the exemplary embodiment as shown in FIGS. 1*a*-1*d* and 2*a*-2*d*, the extension of the dispenser in the transverse direction Y is obtained by having the abutment panel connected to the frame of the dispenser. In this manner, it becomes possible to increase the length of the dispenser in the transverse direction in a simple, yet effective manner, and without compromising the overall function of insert dispenser and the cabinet. The transverse length of the abutment panel and the transverse length of the frame of the dispenser are typically selected in view of the inner depth E of the cabinet in order to ensure that the overall extension D of the dispenser is larger than the inner depth of the cabinet.

By using an insert dispenser with a larger extension in the transverse direction than an inner depth of the cabinet, it is believed that the cabinet front door will somewhat deform when set in the closed configuration with the housing of the cabinet. In this manner, the inner volume of the frame containing the stack of sheet products can maintain its size in order to ensure a safe and reliable dispense of the stack of sheet products. Accordingly, as mentioned above, when the cabinet is in the closed configuration, the abutment panel of the dispenser urges the cabinet front door in a direction away from the frame of the dispenser.

The cabinet front door is typically made from a flexible material. In this context of the exemplary embodiments, the flexibility of the cabinet front door should at least be on a level sufficient so that the inner part of the door yields when the abutment panel urges the door in a direction away from the frame of the dispenser. By way of example, the flexible material can be a plastic material or a thin steel material with a thickness of about 0.5-1 mm, typically between about 0.6-0.8 mm. In other words, a cabinet front door having a sufficiently flexible inner side facing the dispenser is configured to bulge upon contact with the abutment panel when the abutment panel is arranged on the frame of the dispenser to urge the cabinet front door in a direction away from the frame of the dispenser. However, it should be readily appreciated that the exemplary embodiments of the insert dispenser and the cabinet may likewise be used when the cabinet front door is made of a stiffer material.

In one design variant, the cabinet front door is a two-layered front door typically comprising a first inner door segment and a second outer segment, in which the segments are arranged together with a gap in-between the segments. The first segment is typically made of a flexible material, thus provided as a flexible segment. As an example, in this type of door configuration, the first inner door segment is a flexible door segment, whilst the second outer door segment may be either a flexible segment or perhaps a slightly more stiff segment. Accordingly, the inner flexible door segment will bulge upon contact with the abutment panel when the abutment panel is arranged on the frame of the dispenser to urge the inner part of the cabinet front door in a direction away from the frame of the dispenser, whilst the outer door segment typically remains largely unaffected by the abutment panel due to the gap. By way of an example, the gap between the first segment and the second segment may be about 4-8 mm, as seen in the transverse direction.

As mentioned above, the insert dispenser 1 is arranged inside the cabinet 50 with the dispensing opening 5 arranged in connection with the dispensing outlet 52 of the cabinet and with the abutment surface 37 of the abutment panel 38 oriented towards the cabinet front door 54, as seen when the cabinet front door 54 is in the closed configuration with the housing 60 of the cabinet 50. Thus, the abutment surface abuts the cabinet front door. By the arrangement of the abutment panel 38 on the insert dispenser, the dispenser is provided with an abutment surface 37 for delimiting further movement of the cabinet front door towards the frame 10 of the dispenser containing the stack of sheet products. That is, the arrangement of the abutment panel 38 on the insert dispenser 1 prevents that the cabinet front door is pushed further in the transverse direction Y towards the frame of the insert dispenser and the stack of sheet products. Accordingly, when the cabinet front door of the cabinet is in the closed configuration with the housing of the cabinet, the abutment surface 37 of the abutment panel abuts the inner surface of the cabinet front door.

Typically, the abutment panel 38 is arranged to urge the cabinet front door in a direction away from the location of the stack of sheet products. Hence, when the cabinet front door 54 is in the closed configuration with the housing 60 of the cabinet, the abutment panel 38 urges the cabinet front door 54 in a direction away from the frame 10 of the dispenser 1.

Figure 1D:
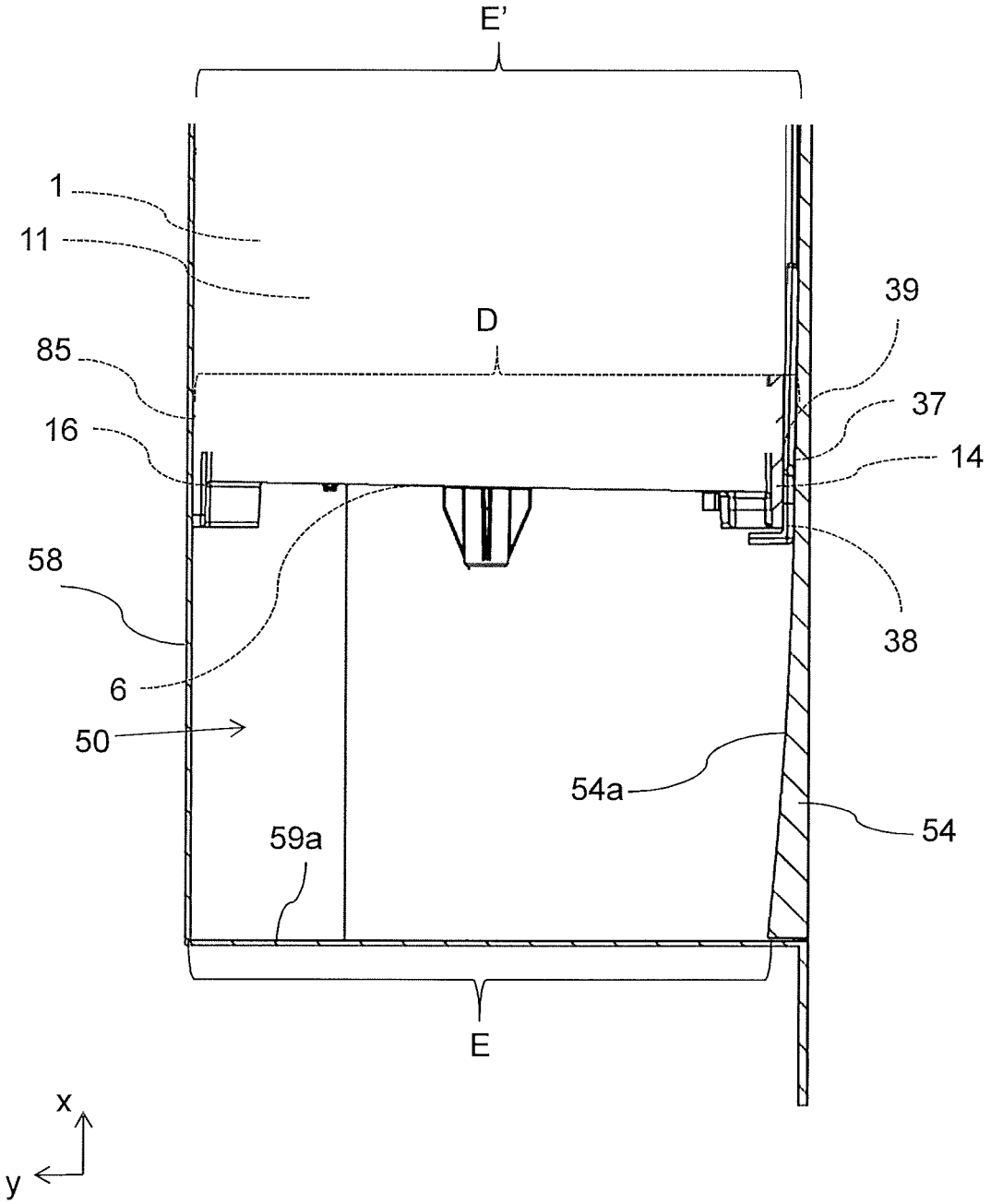
FIG. 1*d* shows an enlarged schematic illustration of a top view of parts of the dispenser arranged in the cabinet according to exemplary embodiments of the disclosure, when the cabinet front door is in a closed configuration with the housing of the cabinet.

FIG. 1*c* shows a schematic illustration of a top view of the dispenser arranged in the cabinet according to exemplary embodiments of the disclosure, and when the cabinet front door is in the closed configuration with the housing, whilst FIG. 1*d* shows an enlarged schematic illustration of a top view of parts of the dispenser arranged in the cabinet according to exemplary embodiments of the disclosure, and when the cabinet front door is in the closed configuration with the housing. In essence, FIG. 1*d* is an enlarged view of the dashed box as shown in FIG. 1*c*.

In these figures, it is schematically illustrated how the abutment panel 38, due to its configuration and arrangement, urges the cabinet front door inner surface 54*a* in a direction away from the frame of the dispenser. As shown in these figures, in particular in FIG. 1*d*, the abutment panel 38 urges an inner part 54*a* of the cabinet front door when the cabinet front door is in the closed configuration with the housing of the cabinet. In this context, the inner part typically refers to the cabinet front door inner surface 54*a*. Further, reference number E' here indicates the distance from the inner surface of the rear wall segment 58 of the cabinet to the inner surface of the partly deformed cabinet front door, which essentially corresponds to the extension D, as defined herein, due to that the extension D of the dispenser in the transverse direction Y is larger than the inner depth E of the cabinet, as seen in the transverse direction Y, causing a deformation of the inner part 54*a* of the cabinet front door when the cabinet front door is closed to the housing (i.e. in the closed configuration). As should be evident from the above, the exemplary advantage of the exemplary embodiments are provided by the insert dispenser according to the above when it is arranged in the cabinet so that the extension D of the dispenser in the transverse direction Y is larger than the inner depth E of the cabinet, as seen in the transverse direction Y. In this context of the disclosure, it is to be noted that the difference between the extension D of the dispenser and the inner depth E of the cabinet must not be selected so that the overall function of the cabinet is negatively affected. Thus, a level of the difference between the extension D of the dispenser and the inner depth E of the cabinet should be selected to ensure that the cabinet front door cannot prevent or disturb the dispense of the sheet products from the insert dispenser, whilst still allowing the cabinet front door to be arranged in its closed configuration with the housing of the cabinet. By way of an example, the difference between the extension D of the dispenser and the inner depth E of the cabinet (as seen in the transverse direction Y) is about 2-5 mm. It should be readily understood that the difference between the extension D of the dispenser and the inner depth E of the cabinet is typically measured at the abutment panel in the transverse direction Y.

Many of the cabinets are dimensioned with a length in the transverse direction of about 90-100 mm. A common standard inner dimension for cabinets is about 92 mm, as seen in the transverse direction.

In order to ensure that the insert dispenser has an extension D which is larger than the inner depth E of the cabinet, as seen in the transverse direction Y, it may typically be necessary to compare the dimensions of the insert dispenser with the inner dimensions of an empty cabinet, thus avoiding that the arrangement of the insert dispenser in the cabinet has an impact on the state of the cabinet, e.g. when the cabinet front door is in the closed configuration with the housing. In other words, the inner depth E of the cabinet refers to a length of the cabinet when the cabinet and the cabinet front door is in a non-deformable state. Generally, the cabinet front door is deformed when the cabinet front door is closed, i.e. forming the closed configuration with the housing, due to the presence of a somewhat larger insert dispenser (as seen in the transverse direction Y) compared to the inner depth of the cabinet housing.

Thus, it is to be noted that the provision relating to the extension D of the dispenser in the transverse direction Y being larger than the inner depth E of the cabinet, as seen in the transverse direction Y, typically refers to a comparison between the insert dispenser and the cabinet when the cabinet front door is in a non-deformable state.

Accordingly, the inner depth E of the cabinet 50 corresponds to the maximum inner depth as defined in a non-deformable state of the cabinet when the cabinet is without the insert dispenser and the cabinet front door is in the closed configuration with the housing of the cabinet. In this context, the term "cabinet without the insert dispenser" typically refers to an empty cabinet.

By way of example, when the housing of the cabinet comprises a cabinet side wall segment as shown in FIGS. 1*a*-1*d*, the inner depth E of the cabinet is defined by the transverse length of an inner surface 59*a* of the cabinet side wall segment 59. In addition, or alternatively, the inner depth E of the cabinet is defined by the transverse length of an inner surface 57*a* of the other opposite cabinet side wall segment 57. In this context of the exemplary embodiments, the transverse length of the inner surface of the cabinet side wall segment extends between the inner surface of the rear wall segment 58 and the inner surface 54*a* of the cabinet front door 54, as seen when the cabinet front door is in the closed configuration with the housing of the cabinet and when the cabinet is empty, i.e. without containing the insert dispenser.

In an example when the cabinet housing 60 comprises the rear wall segment 58, the extension D of the dispenser in the transverse direction Y is defined as the distance between a surface 85 of the dispenser intended for abutting the rear wall segment 58, when the dispenser 1 is arranged in the cabinet, and the abutment surface 37 of the abutment panel 38 of the dispenser. In the exemplary embodiment illustrated in FIGS. 1*a*-1*d* and 2*a*-2*d*, the second transverse edge surface 16 of the frame panel portion 6 corresponds to the surface 85. However, the surface 85 may also be formed by other components of the dispenser, e.g. when the dispenser is provided with an extension member 80, as further described herein.

It is also to be noted that the abutment panel 38 typically abuts an outermost longitudinal region 53 of the cabinet front door 54, as seen when the cabinet front door is in the closed configuration with the housing of the cabinet. In this manner, the abutment panel 38 is arranged to delimit the movement of the cabinet front door in an optimal manner. However, it is also to be noted that the abutment panel can be arranged and oriented at a different location as long as the function of the cabinet and the dispenser is not compromised. In this context of the exemplary embodiments, "outermost" refers to the extension of the cabinet front door along the longitudinal direction X.

As mentioned above, the insert dispenser comprises an abutment panel connected to the first transverse edge surface 14 of the frame panel portion, e.g. the first side panel portion 6 of the dispenser. However, the abutment panel may in one exemplary embodiment be an integral portion of the frame, thus extending from the frame as seen in the transverse direction Y, and typically also a substantial part in the vertical direction Z and a substantial part in the longitudinal direction X. Analogously, in the example when the dispenser comprises a frame with a frame panel portion, in which the abutment panel extends from the frame panel portion in the longitudinal direction X, the inner depth E of the cabinet corresponds to the maximum inner depth, as defined in a non-deformable state of the cabinet when the cabinet is without the insert dispenser and the cabinet front door is in the closed configuration with the housing of the cabinet.

Likewise, the inner depth E of the cabinet in this example is defined by the transverse length of the inner surface of the cabinet side wall segment. Also, when the cabinet housing comprises the rear wall segment 58, the extension D of the dispenser in the transverse direction Y is defined as the distance between the surface 85 of the dispenser intended for abutting the rear wall segment 58, when the dispenser is arranged in the cabinet, and the abutment surface of the abutment panel. Typically, also in this example, the abutment panel abuts the outermost longitudinal region of the cabinet door, as seen when the cabinet front door is in the closed configuration with the housing of the cabinet. It is to be noted that when the extension D of the dispenser in the transverse direction Y is larger than the inner depth E of the cabinet, as seen in the transverse direction (Y) and when the cabinet front door is in the closed configuration with the housing of the cabinet, the abutment panel urges the cabinet front door in a direction away from the frame of the dispenser.

In one design variant, the dispenser further comprises a stack support structure 4 around the dispensing opening for supporting and engaging a front face of the stack. The dispenser is here arranged inside the cabinet with the stack support structure arranged in connection with the dispensing outlet 52 of the cabinet and with the abutment surface oriented towards the cabinet front door, whereby the abutment surface abuts the cabinet front door when the cabinet front door is in the closed configuration with the housing of the cabinet. The support structure 4 is arranged with respect to the side panel portions 6 and 7 such that the dispenser can be mounted in a cabinet. The support structure 4 may comprise a support surfaces to which the stack of sheet products abuts when received in the storage compartment formed by the frame panel portions.

Figure 2A:
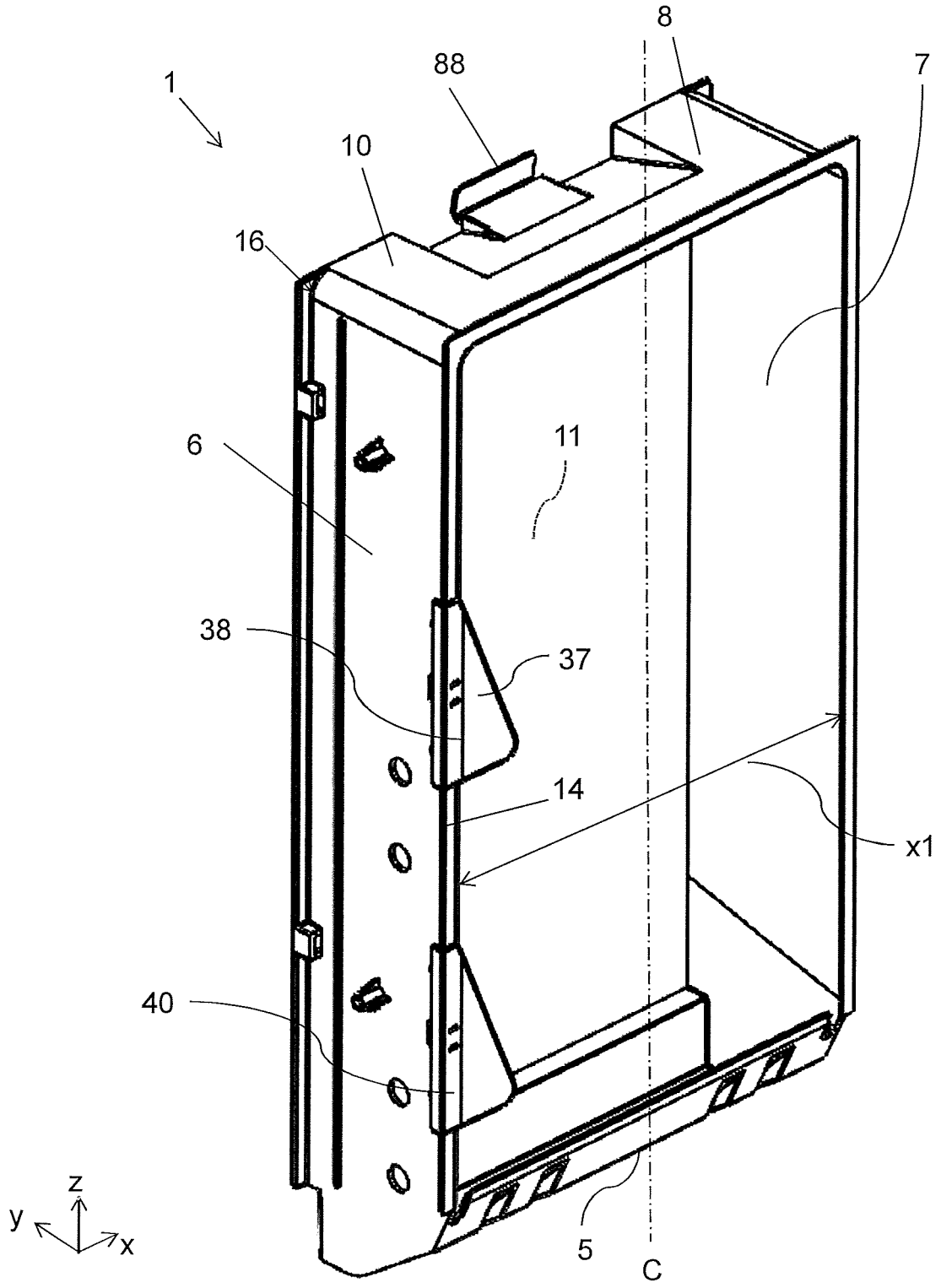
FIG. 2*a* shows a schematic illustration of a perspective view of the dispenser according to one exemplary embodiment of the disclosure, in which a set of abutment panels are connected to an transverse edge surface of a frame panel portion of the dispenser.

The insert dispenser 1 comprising the abutment panel 38 will now be further described in relation to the FIGS. 2*a*-3*c*. This type of insert dispenser can be installed in the cabinet as described above and illustrated in FIGS. 1*a* and 1*b*. FIG. 2*a* illustrates a perspective view of one exemplary embodiment of the insert dispenser 1. FIG. 2*b* shows an embodiment of the dispenser with various parts separated, for ease of understanding. As mentioned above, the insert dispenser is intended for installation in the cabinet 50.

The dispenser comprises the frame 10 partly defining an interior volume 11 for supporting a stack of sheets products. The frame 10 has a frame panel portion 6, 7, 8 extending in the transverse direction Y. As an example, each one of the frame panel portions 6, 7, 8 extends a length d1 in the transverse direction Y, as shown in e.g. FIG. 2*d*.

Each one of frame panel portions has first transverse edge surface 14 and second transverse edge surface 16. Typically, the first transverse edge surface 14 is oriented opposite the second opposite transverse edge surface 16 on the frame panel portion.

In the design variant as shown in the FIGS. 2*a*-2*d*, the frame panel portion is a first side panel portion 6. The first side panel portion essentially extends along the vertical direction Z.

In other words, the first side panel portion 6 has a first transverse edge surface 14 and a second transverse edge surface 16. Typically, the first transverse edge surface 14 is oriented opposite the second opposite transverse edge surface 16 on the first side panel portion.

Typically, although not strictly required, the frame here comprises a second side panel portion 7. The second side panel portion essentially extends in the vertical direction Z.

Analogously, the second side panel portion has a first transverse edge surface 14 and a second transverse edge surface 16. Typically, the first transverse edge surface 14 is oriented opposite the second opposite transverse edge surface 16 on the second side panel portion.

Typically, although not strictly required, the frame in this example also comprises a third panel portion 8. The third panel portion here extends between the first side panel portion 6 and the second side panel portion 7, as seen in the longitudinal direction X.

Accordingly, the third panel portion is a longitudinal extending panel portion essentially extending in the longitudinal direction X.

Analogously, the third panel portion 8 has a first transverse edge surface 14 and a second transverse edge surface 16. Typically, the first transverse edge surface 14 is oriented opposite the second opposite transverse edge surface 16 on the third panel portion 8.

It is to be noted that all frame panel portions typically have an extension in the vertical direction, an extension in the longitudinal direction X and in the transverse direction Y, as seen in the figures.

Figure 2B:
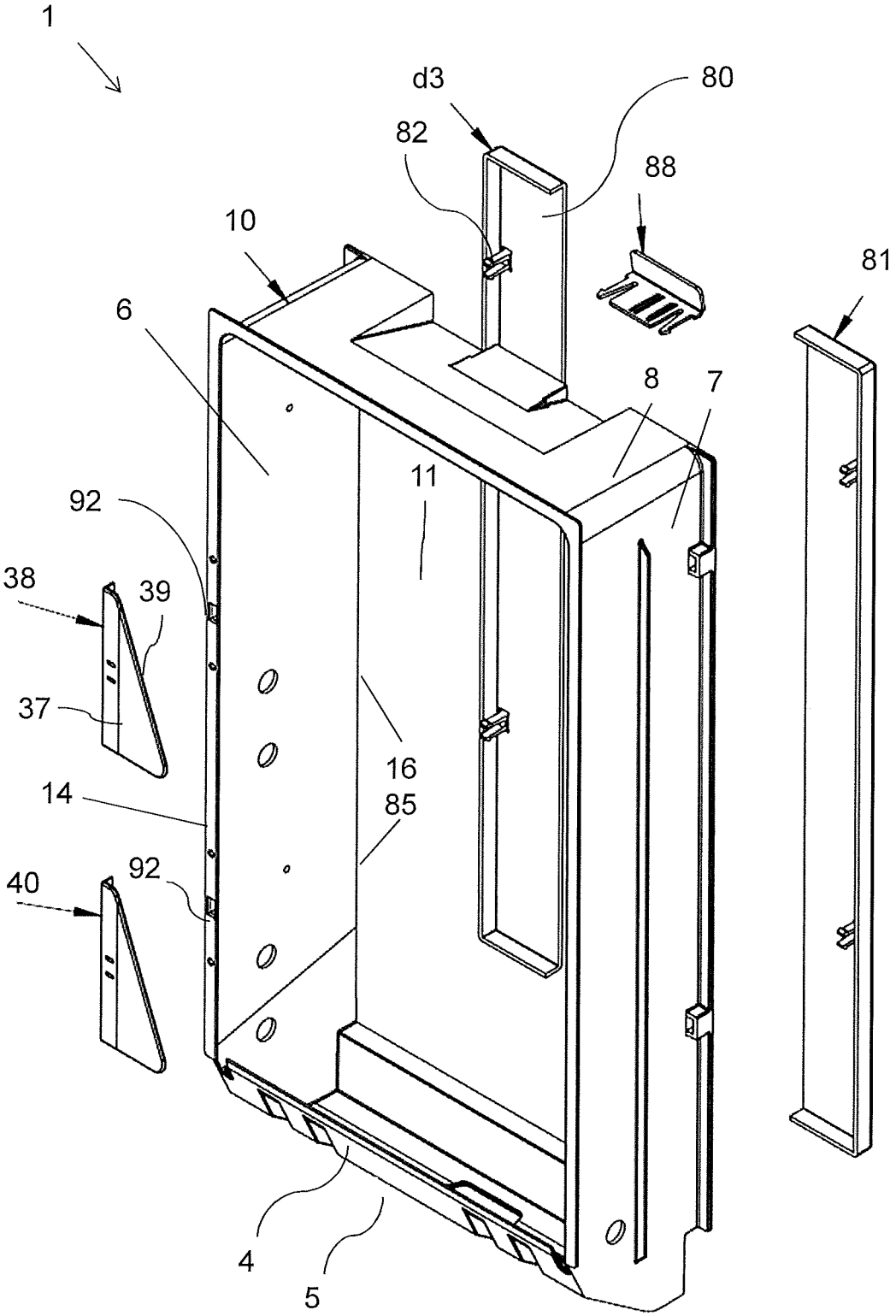
FIG. 2*b* schematically illustrates an exploded view of the exemplary embodiment of the dispenser in FIG. 2*a;*
Figure 2C:
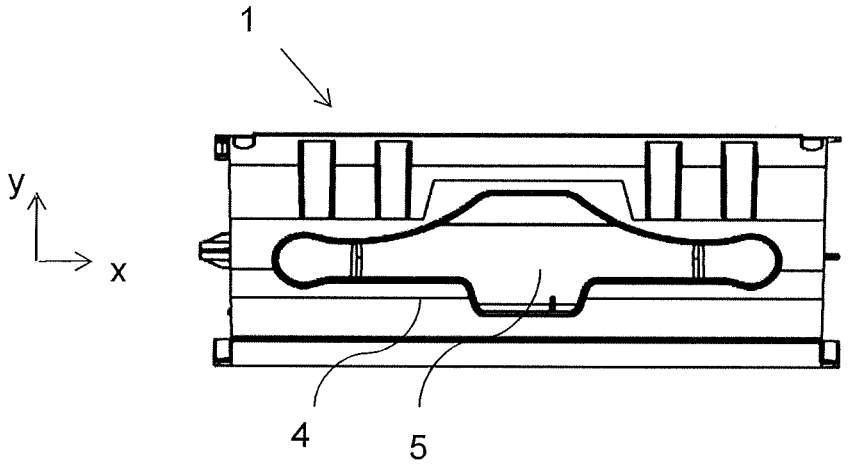
FIG. 2*c* depicts a bottom view of a section of the dispenser in FIGS. 2*a* and 2*b;*
Figure 2D:
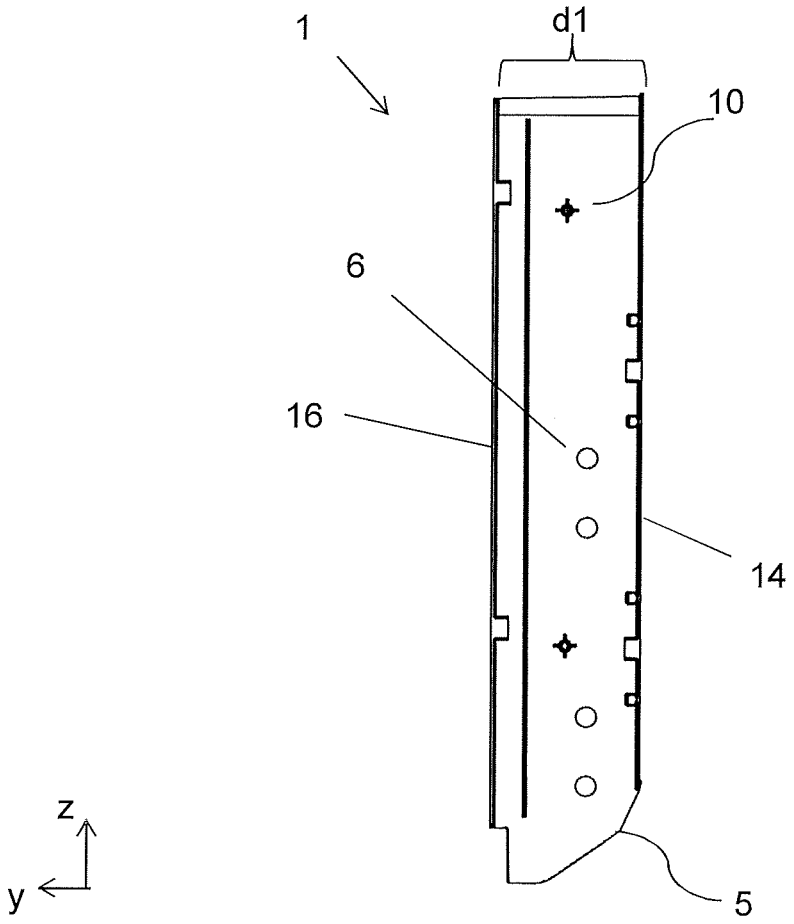
FIG. 2*d* depicts a side view of a section of the dispenser in FIGS. 2*a* and 2*b*, in which the dispenser is shown without an abutment panel.

As shown in e.g. FIGS. 2*a* and 2*b*, the frame 10 is formed by the frame panel portions 6, 7 and 8 to define the interior volume 11. In other words, the first side panel portion 6, the second side panel portion 7 and the third panel portion 8 are arranged to form a storage compartment for receiving and holding the stack of sheet products.

Although not shown, it is to be noted that the frame of the dispenser may only constitute one frame panel portion defining the interior volume, e.g. in the form of a continuous annular frame panel portion. In this manner, the frame is essentially annular-shaped.

In addition, the dispenser 10 in this exemplary embodiment comprises the dispensing opening 5 and the stack support structure 4 around the dispensing opening for supporting and engaging a front face of the stack. It is to be noted that the dispenser may only be provided with the dispensing opening in the form of a cut-out or recess. Alternatively, the dispensing opening 5 may be formed by the arrangement of the frame panel portions or the frame itself, e.g. by a cut-out or recess in the frame of the dispenser. Typically, the sheet stack support structure includes a dispensing opening in the form of a peripheral cut-out or recess to allow a user to grasp at least one hanging sheet product from the dispensing opening.

The support structure 4 is arranged at the dispensing end of the dispenser 1, and typically comprises the opening 5 through which the sheets can be dispensed. The support structure 4 is arranged with respect to the side panel portions 6 and 7 such that the dispenser can be mounted in a cabinet. The support structure 4 may comprise a support surfaces to which the stack of sheet products abuts when received in the storage compartment formed by the frame panel portions.

Figure 3A:
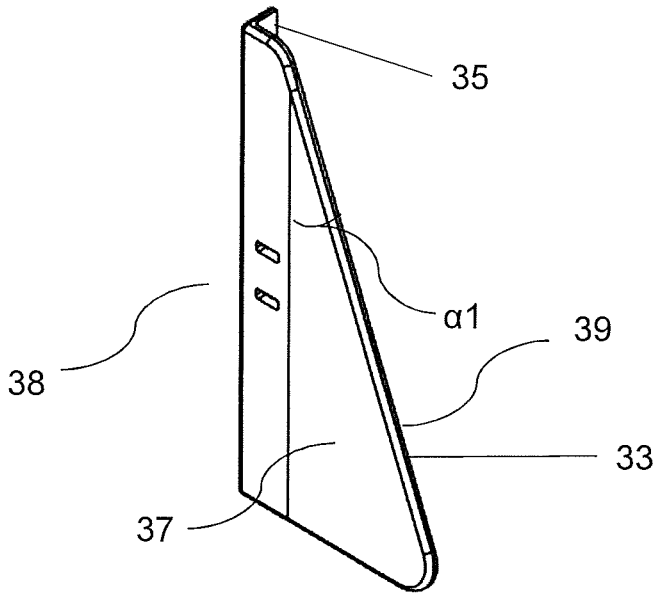
FIGS. 3*a* to 3*c* illustrate an exemplary embodiment of an abutment panel of the dispenser according to the disclosure.
Figure 3B:
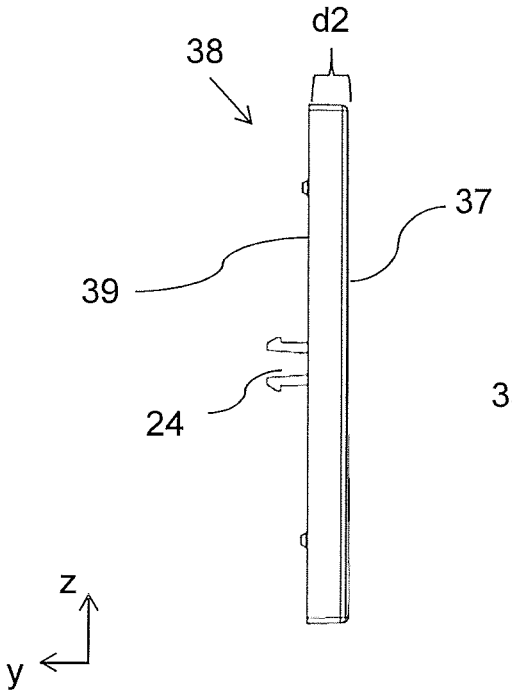
Figure 3C:
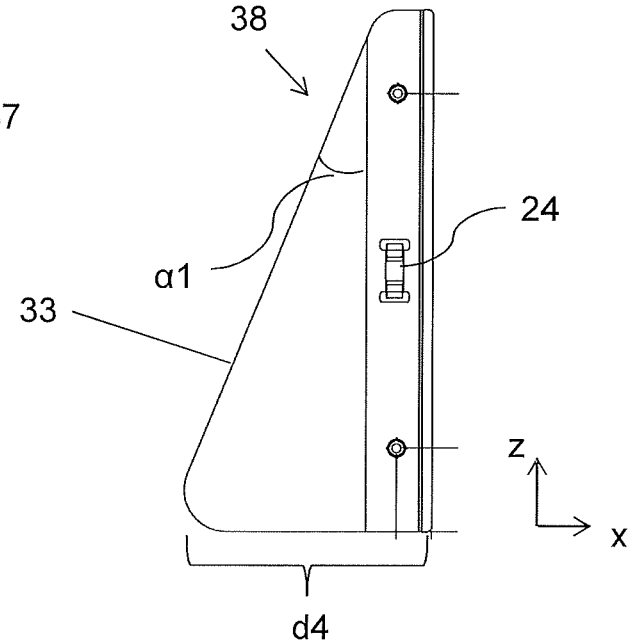

As shown in the FIGS. 2*a* and 2*b*, and further described in conjunction with FIGS. 3*a*-3*c*, the dispenser comprises the abutment panel 38. The abutment panel 38 extends in the transverse direction Y. In this example, the abutment panel 38 extends a length d2 in the transverse direction Y, see e.g. FIG. 3*b*. Typically, the abutment panel also extends a substantial part in the vertical direction Z and a substantial part in the longitudinal direction X. As illustrated in FIG. 2*a*, the abutment panel also extends a substantial part in the vertical direction Z and a substantial part in the longitudinal direction X towards a centre line C of the dispenser 1.

Further, the abutment panel 38 has an abutment surface 37 for abutting the cabinet front door inner surface 54*a*. The abutment panel also has a frame facing surface 39 connected to the first transverse edge surface 14 of the frame panel portion. The abutment surface 37 is here opposite arranged the frame facing surface 39. As shown in FIG. 2*a*, when the frame panel portion is the first side panel portion 6, the abutment panel has a frame facing surface 39 connected to the first transverse edge surface 14 of the first side panel portion 6.

By this configuration of the exemplary embodiments of the dispenser, it becomes possible to increase the length of the dispenser in the transverse direction Y in a simple, yet effective manner, and without compromising the overall function of the insert dispenser.

Thus, when the insert dispenser is arranged in the cabinet, the abutment surface of the abutment panel abuts the cabinet front door when the cabinet front door is in the closed configuration with the housing of the cabinet.

By way of an example, when the insert dispenser is arranged in a cabinet and when the cabinet front door of the cabinet is in a closed configuration with housing of the cabinet, the abutment surface of the abutment panel is capable of abutting the inner surface of the cabinet front door. In this manner, there is provided an insert dispenser having an abutment panel configured to abut the cabinet front door in order to avoid, or at least minimize the risk, that the cabinet door negatively influences the dispense of the sheet products when the cabinet is to be used, i.e. when the cabinet door is closed.

Another exemplary advantage of the abutment panel of the dispenser is to provide support for the stack of sheet products, such that the stack will not fall out from the frame of the dispenser, e.g. when the cabinet front door is opened by a user.

In the example as shown in the figures, the first transverse edge surface 14 has an essential length in the vertical direction Z. In addition, as illustrated in the figures, the first transverse edge surface 14 extends across the X-Z plane. Thus, the length of the first transverse edge surface 14 typically corresponds to the length of the frame panel portion as seen in the vertical direction Z. The first transverse edge surface 14 and the second transverse edge surface 16 are disposed on opposite edges of the frame panel portion, as seen in the transverse direction Y. When the dispenser is arranged in the cabinet, the first transverse edge surface 14 is thus the edge of the frame panel portion which is arranged to face the cabinet door 54, i.e. the cabinet front door inner surface 54*a*. Accordingly, when the dispenser is arranged in the cabinet, the second transverse edge surface 16 is the edge of the frame panel portion which is arranged to face an inner rear wall of the cabinet, e.g. the real wall segment 58.

Analogously, the second transverse edge surface 16 has an essential length in the vertical direction Z. In addition, as illustrated in the figures, the second transverse edge surface 16 extends across the X-Z plane. Thus, the length of the second transverse edge surface 16 typically corresponds to the length of the frame panel portion as seen in the vertical direction Z.

Each one of the frame panel portions in this exemplary embodiment is also provided with opposite longitudinal edge surfaces and opposite vertical edge surfaces, as may be gleaned from the FIGS. 2*a*-2*d*.

In one exemplary embodiment (although not shown), the frame panel portion is a longitudinal extending panel portion essentially extending in a longitudinal direction X. As an example, the longitudinal extending panel portion corresponds to the third panel portion.

In the exemplary embodiment described in relation to FIGS. 2*a*-2*d* and 3*a*-3*c*, the frame 10 and the abutment panel 38 are separate parts of the dispenser. Thus, the abutment panel 38 is an individual part of the dispenser. Analogously, the frame is an individual part of the dispenser.

The longitudinal extension of the dispenser, as seen in the longitudinal direction X, is typically selected in correspondence with the sheet products to be dispensed, especially in correspondence with the width of the stack of sheet products such that the respective sheets can be efficiently dispensed, one at a time, without breaking or tearing. For example, the inner longitudinal extension $X_1$ of the dispenser is typically at least 5 cm, in some variants at least 10 cm. Typically, the inner longitudinal extension $X_1$ of the dispenser is within 5-30 cm. The inner longitudinal extension $X_1$ of the dispenser is illustrated in FIG. 2*a*.

The dispenser is typically designed so that the distance between the first and second side panel portions 6, 7 allows for arranging a stack of sheet products of a conventional size.

The connection of the abutment panel to the first transverse edge surface 14 can be provided in several different ways. As an example, the abutment panel 38 is permanently connected to the first transverse edge surface 14 of the frame panel portion, e.g. first side panel portion 6. By way of example, the abutment panel is glued or welded to the first transverse edge surface of the frame panel portion.

Alternatively, the abutment panel is detachable connected to the first transverse edge surface 14 of the frame panel portion, e.g. panel portion 6. A detachable connected abutment panel is illustrated e.g. in FIGS. 2*a* and 3*a*-3*c*. By way of example, the abutment panel comprises a snap fit mechanism 24 configured to detachably connect the abutment panel to the first transverse edge surface of the frame panel portion, as shown in FIGS. 2*a* and 2*b*. In this context of the example of the insert dispenser, the frame panel portion comprises a plurality of connecting regions 92 configured for connecting the abutment panel onto the first transverse edge surface 14.

In some design variant, the position of the detachable connected abutment panel is adjustable along the first transverse edge surface 14 of the frame panel portion. This may be provided by having a snap fit mechanism disposed on the abutment panel and a set of connecting regions on the first transverse edge surface, as shown in the e.g. FIG. 2*b*.

In addition, or alternatively, the adjustable abutment panel is slidably arranged along a guiding recess (not shown) extending in the vertical direction Z along on said first transverse edge surface 14 of the frame panel portion. Other types of detachable connections are conceivable in the context of the exemplary embodiments. As an example, when the frame panel portion comprises the plurality of connecting regions, each one of the connecting regions 92 are configured for connecting an adjustable abutment panel onto the first transverse edge surface. In this manner there is provided an insert dispenser in which an adjustable abutment panel is permitted to be connected and positioned at several different locations.

In certain design variants of the abutment panel, as shown in e.g. FIGS. 3*a*-3*c*, the abutment panel 38 is a bracket-shaped member. In this context of the example, the frame facing surface is a first frame facing surface 39. In addition the bracket-shaped abutment panel has a second frame facing surface 35, which is arranged perpendicular to the first frame facing surface 39. In this manner, the stability of the connection between the abutment panel and the frame panel portion is further improved.

As illustrated in the figures, particularly in FIGS. 3*a* and 3*c*, the abutment panel 38 essentially resembles a right angled triangle, as seen in the vertical direction Z and in the longitudinal direction X, whereby a side region surface of the abutment panel 38 adjacent the right angle is connected to the first transverse edge surface 14 of the frame panel portion, e.g. the first side panel portion 6.

Typically, although not strictly required, the abutment panel extends a substantial part in the vertical direction Z and substantial part in the longitudinal direction X, while extending in the longitudinal direction X towards a centre line C of the dispenser.

It has been noticed that an abutment panel extending a substantial part in the longitudinal direction may generally somewhat follow the contour of the cabinet front door inner surface when the insert dispenser is arranged in the cabinet so that the abutment panel urges the cabinet front door panel in a direction away from the frame.

In certain designs of the abutment panel, the abutment panel also provides support for the sheet products so that when the cabinet door is in an open position, i.e. the open configuration, the abutment panel prevents sheet products leaning toward the door from falling out of the cabinet.

Further, as shown in FIGS. 3*a*-3*c*, a side 33 of the abutment panel opposite the right angle defines an angle of entry α1 for the sheet products to be dispensed in the vertical direction Z. Typically, the angle of entry is less than or equal to 35 degrees, still preferably said angle of entry is less than or equal to 30 degrees, still preferably said angle of entry is less than or equal to 25 degrees.

The width of the abutment panel, as seen in the vertical direction Z, may vary considerably, depending on the size, structure and installation of the dispenser as well as on the dimension and type of cabinet concerned.

By way of example, the widest region of the abutment panel, as seen in the vertical direction Z, may have an extension in the vertical direction Z of between approximately 5%-50% of the length of the frame panel portion, as seen in the vertical direction Z, more preferably between 10%-30%, still preferably between about 15%-25%

Furthermore, as an example, the widest region of the abutment panel, as seen in the vertical direction Z, may have an extension in the vertical direction Z of approximately 3 to 25 cm, more preferably between 5-15 cm, still preferably between about 7-12 cm.

Typically, although not strictly necessary, the widest region of the abutment panel is connected to the transverse edge surface of the frame panel portion in order to ensure a secure and stable configuration.

As should be readily understood from the description with particular reference to FIGS. 1*a*-1*b* and 2*a*-2*d*, the dispenser may comprise several abutment panels 38, 40. Thus, in certain design variants, the dispenser comprises a plurality of abutment panels 38, 40 connected spaced apart to the first transverse edge surface 14 of the frame panel portion, as seen in the vertical direction Z.

The abutment panels 38, 40 are connected to the first transverse edge surface 14 so that each one of them extends from an outer edge of the first side panel portion 6, and respectively oriented in a direction toward the second side panel portion 7. As shown in FIGS. 1*a*-2*d*, the dispenser here comprises the first abutment panel 38 and a second abutment panel 40.

The first abutment panel 38 may be connected perpendicularly to the first side panel portion 6, or it may be inclined slightly inwards. The second abutment panel 40 may be connected perpendicularly to the first side panel portion 6, or it may be inclined slightly inwards in an analogous manner.

In certain design variants, the first abutment panel 38 and a second abutment panel 40 are also arranged to hold the stack of sheet products in its proper place in the frame, i.e. in the storage compartment such that it is properly oriented towards the dispensing opening 5. Further the first abutment panel 38 and a second abutment panel 40 prevent the sheet products from falling out if the door 54 of the cabinet 50, in which the dispenser 1 is mounted, is opened. The first abutment panel 38 and a second abutment panel 40 typically extend along at least a portion of the first transverse edge surface 14, respectively.

In certain design variants, the first abutment panel 38 and a second abutment panel 40 are connected to opposite arranged panel portions, e.g. panel portions 6 and 7.

As shown in the FIGS. 1*a*-2*d*, the first abutment panel 38 and a second abutment panel 40 are connected and arranged to the first transverse edge surface 14 with an offset to each other. Thereby material, and thus also weight, can be saved.

Each one of the abutment panels of the dispenser may include any one of the features, effects or functions as described in relation to the abutment panel 38 herein.

As will be readily understood from the description and with particular reference to FIGS. 1*a*-1*b* and 2*a*-2*d*, one exemplary advantage of the exemplary embodiments of the present disclosure is to provide a dispenser with an abutment surface for delimiting further movement of a cabinet front door of a cabinet towards the frame of the dispenser containing the stack of sheet products. That is, the arrangement of the abutment panel extending in the transverse direction and being connected to the transverse edge surface of the insert dispenser prevents that the cabinet front door is pushed further in the transverse direction Y towards the frame of the insert dispenser and the stack of sheet products. Accordingly, the insert dispenser is configured by the abutment panel to safeguard that there is sufficient space for the stack of the sheet products in the frame of the dispenser when the insert dispenser is installed and used in a conventional existing cabinet. To this end, the insert dispenser according to the above configurations contribute to improve the interaction between the insert dispenser and the cabinet and the overall functionality of system so that sheet products can be easily dispensed from the system in use.

In order to ensure the proper feeding of the sheet products, the dispenser may be configured so that the stack is pressed against the support structure. This could be by way of gravitational force (gravity feed dispenser) or by way of spring force or the urging force of some other biasing member. The support structure and the interior volume may be configured such that the other side of the sheet product is pinched between the support structure and the remainder of the stack. Accordingly, in an embodiment, the dispenser is a gravity feed dispenser in which the interior volume is adapted to be positioned above the dispensing opening.

In certain design variants, the dispenser may further comprise a dispensing member for dispensing a selected number of sheet products through the dispensing opening 5.

In order for the frame to define an interior volume sufficiently big to accommodate the stack of sheet products, the interior volume should have a minimum extension in the directions X, Y and Z which corresponds to the dimensions of the stack of the sheet products. In this manner, the frame comprises a storage compartment for the stack of sheet products. The storage compartment is arranged to stack the sheet products prior to use and the dispenser is configured to dispense the sheet products through the dispensing opening.

Typically, the interior volume is adapted to be positioned above the dispensing opening of the dispenser. Typically, the dispensing opening should be adapted so as to ensure that towels can be pulled out without tearing or breaking the sheet products and that sheet products may be dispensed properly one by one.

Furthermore, in some design variants, the dispenser has a dispensing opening and stack support structure around the dispensing opening for engaging a front face of the stack.

The stack of sheet products for hygiene products, for use in a dispenser, comprising at least one interleaved sheet product.

The stack is disposed in the frame and typically rests against an inner surface of the support structure 4.

The aspects and embodiments described above, and which are explained in further detail below, may be broadly applicable to several different types of insert dispensers, such as, and without limitation, gravity feed dispensers, folded bath tissue dispensers, hand towel folded or interleaved dispensers, napkin dispensers. As stated above, the sheet products are generally used for wiping, and may be folded and/or interleaved and may be tissue-based sheet products.

Optionally, although not strictly necessary, the side panel portions 6 and 7 may be arranged such that they have a smaller dimension in all parts except the parts where abutment panels 38, 40, respectively, are provided. Thereby, a clash or other interference with a lock for locking the door 54 of the cabinet 50, into which the dispenser 1 is to be mounted, may be prevented. Accordingly, the dimensions of the frame panel portions and the dimensions and positions of eventual open areas or areas of smaller dimension may be varied, as long as the structural stability and efficient functioning of the dispenser 1 is maintained and the abutment panel is arranged to abut the cabinet front door.

Furthermore, in the exemplary embodiment illustrated in FIGS. 2*a*-2*b*, the dispenser here comprises a set of two vertical extension members 80 and 81. Each one of the vertical extension members extends essentially in the longitudinal direction X and the vertical direction Z. Also, each one of the extension members has a distance d3 in the transverse direction Y. As illustrated in FIG. 2*a*, the extension member is connected to the second transverse edge of the frame panel, which in this embodiment corresponds to the transverse edge facing the inner rear wall surface of the cabinet. The extension member is configured to be detachable connected to the second transverse edge of the frame panel. By way of an example, the detachable connection is provided by one or several snap fit mechanism 82. It is to be noted that the extension member is only an optional component of the dispenser, and that the exemplary embodiments of the dispenser and the cabinet may be provided with or without an extension member, depending on the design and installation of the dispenser in the cabinet.

The dispenser 1 may be fixed in position inside the cabinet by any manner known in the art, for example by using adhesive tape, otherwise applied adhesives or mechanical means. Further, the longitudinal panel portion 8 may be provided with an adhesive tape along its full length such that the dispenser is easily mounted and fixed within the cabinet 50. Other fixation means or fixation devices are also conceivable as long as the dispenser can be fixated in position in a secure and reliable manner. One example of a fixation device 88 is illustrated in FIGS. 2*a* and 2*b*. In this manner, the dispenser is arranged and fixated inside the cabinet.

The dispenser 1 described above may be mounted into a variety of different cabinets 50. Thus, cabinets may be retrofitted with the dispenser 1 such that it is not necessary to replace already installed cabinets if there is a wish to change to other types of web materials.

It is also possible to fabricate cabinets with the dispenser 1 being an integral part therein. In such cases, the cabinet may basically comprise a housing enclosing the dispenser and a dispensing outlet in connection with the dispensing opening of the dispenser. The dispensing outlet of the housing may be merely an opening through which sheets of web material can be dispensed, since the proper dispensing of the web material may be taken care of by a dispensing portion of the dispenser mounted inside the cabinet.

As will be realised, the disclosure is capable of modification in various obvious respects, all without departing from the scope of the appended claims. Accordingly, the drawings and the description are to be regarded as illustrative in nature, and not restrictive. Thus, reference signs mentioned in the claims should not be seen as limiting the extent of the matter protected by the claims, and their sole function is to make claims easier to understand.

Features illustrated in the different example dispensers and exemplary embodiments described above may be combined as understood by a person skilled in the art. Although the disclosure has been described with reference to example dispensers, many different alterations, modifications and the like will become apparent for those skilled in the art.

As used herein, the term "comprising" or "comprises" is open-ended, and includes one or more stated features, elements, steps, components or functions but does not preclude the presence or addition of one or more other features, elements, steps, components, functions or groups thereof. Similarly, the use of terms such as "including" is open-ended and is intended to have the same meaning as terms such as "comprising" and not preclude the presence of other structure, material, or acts. Similarly, though the use of terms such as "can" or "may" is intended to be open-ended and to reflect that structure, material, or acts are not necessary, the failure to use such terms is not intended to reflect that structure, material, or acts are essential. To the extent that structure, material, or acts are presently considered to be essential, they are identified as such.

The invention claimed is:

1. A cabinet comprising a cabinet front door, a housing defining an inner depth in a transverse direction, a dispensing outlet for sheet products and an insert dispenser comprising a dispensing opening, said dispenser having an extension in the transverse direction and comprising a frame partly defining an interior volume for supporting a stack of sheets products, said frame having a frame panel portion extending in a transverse direction and an abutment panel extending from said frame panel portion in a longitudinal direction, said abutment panel having an abutment surface for abutting a cabinet front door inner surface, said dispenser being arranged inside the cabinet with said dispensing opening in alignment with said dispensing outlet of the cabinet and with said abutment surface oriented towards the cabinet front door, wherein the extension of said dispenser in the transverse direction is larger than the inner depth of said cabinet, as seen in the transverse direction, whereby said abutment surface urges said cabinet front door in a direction away from said frame of said dispenser when said cabinet front door is in a closed configuration with said housing of the cabinet.

2. The cabinet according to claim 1, wherein said frame panel portion is provided with first and second opposite transverse edge surfaces, and said abutment panel is permanently connected to said first transverse edge surface of the frame panel portion.

3. The cabinet according to claim 1, wherein said frame panel portion is provided with first and second opposite transverse edge surfaces, and said abutment panel is detachably connected to said first transverse edge surface of the frame panel portion.

4. The cabinet according to claim 3, wherein said abutment panel comprises a snap fit mechanism configured to detachably connect said abutment panel to said first transverse edge surface of the frame panel portion.

5. The cabinet according to claim 3, detachably connected abutment panel is configured to be positioned at various positions along said first transverse edge surface of the frame panel portion.

6. The cabinet according to claim 5, wherein the adjustable abutment panel is slidable along a guiding recess extending in a vertical direction along said first transverse edge surface of the frame panel portion.

7. The cabinet according to claim 3, wherein said frame panel portion comprises a plurality of connecting regions configured for connecting said abutment panel onto said first transverse edge surface.

8. The cabinet according to claim 1, wherein said abutment panel is a bracket-shaped member and a frame facing surface of the abutment panel is a first frame facing surface, wherein said abutment panel has a second frame facing surface arranged perpendicular to said first frame facing surface.

9. The cabinet according to claim 1, wherein the abutment panel extends in a vertical direction and in a longitudinal direction toward a center line of said dispenser.

10. The cabinet according to claim 9, wherein said frame panel portion is provided with first and second opposite transverse edge surfaces, wherein a first side region surface of the abutment panel forms a right angle with a second side region surface of the abutment panel, and wherein the first side region surface is connected to the first transverse edge surface of the frame panel portion.

11. The cabinet according to claim 10, wherein a vertical axis and a hypotenuse side of the abutment panel opposite the right angle define an angle of entry less than or equal to 35 degrees.

12. The cabinet according to claim 1, said frame panel portion being provided with first and second opposite transverse edge surfaces, and said dispenser comprising a plurality of abutment panels spaced apart from each other in a vertical direction and connected to said first transverse edge surface of the frame panel portion.

13. The cabinet according to claim 1, wherein said frame panel portion is a first side panel portion extending along a vertical direction.

14. The cabinet according to according to claim 13, wherein the frame further comprises a second side panel portion extending in the vertical direction and a third panel portion extending between said first side panel portion and said second side panel portion in the longitudinal direction, wherein said first side panel portion, said second side panel portion and said third panel portion are arranged to form a storage compartment for receiving and holding the stack of sheet products.

15. The cabinet according to claim 1, wherein the dispenser is a hygienic sheet material insert dispenser for supporting a stack of sheet products.

16. The cabinet according to claim 1, wherein:

the inner depth of said cabinet corresponds to the maximum inner depth as defined in a non-deformed state of the cabinet when the cabinet is without said insert dispenser; and said cabinet front door is in the closed configuration with said housing of the cabinet and/or is defined by a transverse length of an inner surface of a cabinet side wall segment.

17. The cabinet according to claim 1, wherein said cabinet housing comprises a rear wall segment, said extension of said dispenser in the transverse direction being defined as the distance between a surface of the dispenser configured for abutting the rear wall segment, when said dispenser is arranged in said cabinet, and the abutment surface of the abutment panel.

18. The cabinet according to claim 1, wherein the abutment panel abuts an outermost longitudinal region of the cabinet front door, as seen when said cabinet front door is in the closed configuration with said housing of the cabinet.

19. The cabinet according to claim 1, wherein the dispenser is a hygienic sheet material insert dispenser for supporting a stack of hand towels, toilet tissue, napkins, or other wiping products in sheet form.

* * * * *